US006349793B1

(12) United States Patent
Kincaid

(10) Patent No.: US 6,349,793 B1
(45) Date of Patent: Feb. 26, 2002

(54) VEHICLE MOUNTED LIFTING APPARATUS AND METHOD

(76) Inventor: Duane Kincaid, 2268 S. 3500 West, Ogden, UT (US) 84401

( * ) Notice: Subject to any disclaimer, the term of this patent is extended or adjusted under 35 U.S.C. 154(b) by 0 days.

(21) Appl. No.: 09/491,739

(22) Filed: Jan. 27, 2000

(51) Int. Cl.[7] ..... E06C 1/00; E04G 1/18; B65F 9/00

(52) U.S. Cl. ..... 182/69.4; 182/141; 414/347

(58) Field of Search ..... 182/69.6, 141, 182/127, 69.4; 414/334–336, 347, 399, 498, 919

(56) References Cited

U.S. PATENT DOCUMENTS

| | | | | | |
|---|---|---|---|---|---|
| 3,018,842 | A | * | 1/1962 | Abrell | 182/141 X |
| 3,614,993 | A | * | 10/1971 | Penso | 182/141 X |
| 3,851,854 | A | * | 12/1974 | Roybal | 182/141 X |
| 3,909,057 | A | * | 9/1975 | Guthry | 280/414 X |
| 4,690,250 | A | | 9/1987 | Bergstrom | 187/18 |
| 4,752,102 | A | * | 6/1988 | Rasmussen | 182/141 X |
| 4,890,692 | A | | 1/1990 | Oakman | 182/141 |
| 4,967,733 | A | * | 11/1990 | Rousseau | 182/141 X |
| 5,310,018 | A | * | 5/1994 | Lahaie | 182/141 |
| 6,071,062 | A | * | 6/2000 | Warhurst et al. | 414/498 |
| 6,155,770 | A | * | 12/2000 | Warhurst | 414/498 |

FOREIGN PATENT DOCUMENTS

| | | | | |
|---|---|---|---|---|
| AT | 421977 | * | 4/1991 | 182/141 X |

OTHER PUBLICATIONS

Photographs of vehicle mounted lift, fabricated by Duane Kincaid, 1994.

* cited by examiner

*Primary Examiner*—Daniel P. Stodola
*Assistant Examiner*—Hugh B. Thompson
(74) *Attorney, Agent, or Firm*—Workman, Nydegger & Seeley

(57) ABSTRACT

A lifting apparatus for mounting to a vehicle includes a base assembly that is adapted to cooperate with the vehicle. Extending from a base of the base assembly is a plurality of columns. The base assembly further includes a connecting mechanism that securely attaches the base assembly to a bed of the vehicle. The lifting apparatus further includes a platform assembly having a platform and a plurality of outer column receivers extending from the platform. The outer column receivers cooperatively engage with the columns of the base assembly to allow sliding engagement therebetween. Cooperating with the platform assembly is a driving mechanism that is adapted to elevate the platform assembly relative to the base assembly. The driving mechanism includes a lifting chain, a motor assembly, and a gear assembly. The lifting chain has a first end attached to the base assembly and a second end attached to the platform assembly. The gear assembly drivingly engages with the lifting chain such that upon activation of the motor assembly the gear assembly moves the platform assembly relative to the base assembly.

32 Claims, 10 Drawing Sheets

VEHICLE MOUNTED LIFTING APPARATUS AND METHOD

BACKGROUND OF THE INVENTION

1. The Field of the Invention

The present invention generally relates to devices and methods for gaining additional height to perform various activities. More specifically, the present invention relates to a vehicle mountable lifting apparatus that is adapted for elevating and lowering objects and/or individuals to various desired heights.

2. The Prior State of the Art

Through the ages man has desired to perform activities at different heights, such as harvesting food, maintaining building structures, installing equipment, and the like. With advances in technology, numerous devices have been developed to allow an individual to perform activities at various heights that were previously performed with the use of a ladder or other similar height gaining apparatus. Though many different adjustable platforms or height gaining or lifting apparatus have been developed, these devices have various drawbacks that make them difficult to use or difficult to transport, or have other drawbacks that reduce their effectiveness.

Traditionally, in a working environment, an individual may gain additional height through the use of scaffolding. Scaffolding allows an individual to have a steady platform from which to perform various activities, such as painting, construction, and the like. Generally, scaffolding consists of a number of scaffolding sections, such as supports and cross-members that are connected together to form a scaffolding framework. Upon this framework a number of planks or other platform-type structures are placed that provide an area from which an individual may work or store materials and equipment. Greater height may be achieved with scaffolding by attaching additional scaffolding frameworks and platforms. Though scaffolding is useful for achieving a great height, it is necessary to transport a large number of supports, cross-members, and platforms resulting in high installation costs and extended installation time.

One apparatus that overcomes the difficulties associated with transporting scaffolding is the scissor lift-type platform. Traditional scissor lifts include a number of pivotal lift elements that are each pivotally joined to subsequent lift elements, the platform, and/or the base of the scissor lift. Disposed between the platform and the base member, while being attached to a number of lift elements, is a hydraulic ram. The hydraulic ram raises the platform by moving the individually joined lift elements to form the typical cross-type configuration. Conventionally, the base of the scissor lift includes a driving motor that allows the scissor lift to move from location to location. Alternatively, the scissor-lift may be located on a vehicle, such as a pickup truck, which substitutes for the motorized portion of the base.

Unfortunately, traditional scissor lifts are expensive and costly to use. Furthermore, each scissor lift is somewhat function specific, in that different scissor lifts are required for rough or generally level terrain. Though a few scissor lifts are truck mounted, the majority of the available scissor lifts must be transported to the particular worksite, whether on the back of a vehicle, such as a pickup truck, and then removed, or towed behind a truck. Both truck mounted and mobile scissor lifts are, however, capable of carrying only small loads. Additionally, scissor lifts generally must be lowered to allow an individual to enter or exit the platform making the devices inconvenient to use. Furthermore, typical vehicle mounted scissor lifts are difficult to install and remove from the vehicle as is required for maintenance and the like adding to the costs and inconveniences of use.

Another type of device that allows an individual to gain greater height is the boom-type adjustable platform. Boom-type adjustable platforms have a basket or other platform attached to one end of a sliding boom. The opposite end, distal to the platform or basket, is connected to a base that is capable of moving the sliding boom in various directions, such as rotating the sliding boom about the axis of the base or sliding the boom inwardly or outwardly. This type of lift, however, is only capable of carrying a limited load determined by the load or weight of the base. Too great a load carried on the platform at too acute an angular orientation of the boom relative to the base results in tipping of the adjustable platform. As with the scissor lift apparatus, the boom lift suffers from similar defects in that it must be transported with the aid of another vehicle, such as being pulled behind a truck. Alternatively, the boom-type lift may be driven to a particular location; however, this driving requires a significant amount of time, due to the inherently low traveling speeds of the boom-type adjustable platform.

Various other types of apparatus that are capable of raising a single individual to a specific height are known. Many of these devices, however, are incapable of carrying a sufficient load, such as materials, equipment or the like, that are required by an individual working at a great height. Additionally, these devices are difficult to transport to the location of use and to install on the transporting vehicle. For example, previous vehicle mounted apparatus for gaining additional height require the use of cranes, forklifts, or other lifting devices to securely position the lifting apparatus on the vehicle. Furthermore, many previous vehicle mountable lifting apparatus require difficult or permanent connection to the vehicle, thus requiring significant installation time and expense.

It would be an advance to provide an adjustable lifting apparatus that transports easily and carries large loads. It would be a further advance to have an adjustable lifting apparatus that is capable of being vehicle mounted to thereby allow easy transportation and use of the platform. Still it would be another benefit or advance to have a lifting apparatus that allows an individual to access a platform whether or not the platform is an extended or retracted orientation.

OBJECTS AND SUMMARY OF THE INVENTION

It is an object of the present invention to provide a vehicle mountable lifting apparatus that may elevate objects and/or persons to varying heights.

Another object of the present invention is to provide a vehicle mountable lifting apparatus that can carry various loads having differing lengths and configurations.

Another object of the present invention is to provide a vehicle mountable lifting apparatus that is inexpensive to manufacture while including a large working area.

Yet another object of the invention of the present invention is to provide a lifting apparatus that includes safety mechanisms to ensure the safety of the operators.

Another object of the present invention is to provide a lifting apparatus that can easily be transferred from one vehicle to another without the use of cranes, forklifts, or other similar devices.

It is another object of the present invention to provide a lifting apparatus that uses the characteristics of the vehicle upon which it is mounted to provide stability and support to the lifting apparatus.

A further objective of the present invention is to provide a method for removing and mounting a lifting apparatus to a vehicle.

Additional objects and advantages of the present invention will be set forth in the description that follows in conjunction with the accompanying figures, and in parts will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, a lifting apparatus for mounting to a vehicle is disclosed. The lifting apparatus includes a base assembly that is adapted to cooperate with the vehicle. The base assembly includes a base having a plurality of columns extending therefrom. Coupled to the base is a connecting mechanism, such as a bulldog/goose neck hitch, that allows secure attachment of the base assembly to the vehicle. The lifting apparatus further includes a platform assembly that has a platform and a plurality of outer column receivers extending from the platform. The outer column receivers cooperatively engage with the columns of the base assembly to allow sliding engagement of the platform assembly and the base assembly. In one embodiment, the platform assembly includes a railing assembly that surrounds the peripheral edge of the platform.

Cooperating with the platform assembly and the base assembly is a driving mechanism that is adapted to reversibly elevate the platform assembly relative to the base assembly. The driving mechanism includes a motor assembly that drives a gear assembly. The gear assembly has a plurality of sprockets that cooperate with a lifting chain that is attached to both the base assembly and the platform assembly. As such, as the motor assembly drives the gear assembly, the plurality of sprockets engage with the lifting chain to move the platform assembly or the base assembly relative to each other.

In one embodiment of the present invention, the lifting apparatus further includes a safety mechanism that is adapted for controlling the descent of the platform assembly relative to the base assembly in the event of a malfunction of the lifting apparatus.

The embodiments of the present invention may utilize a method to install and remove the lifting apparatus without the need for traditional installation equipment, such as forklifts, cranes, and the like. The method of installing and removing or loading and unloading the lifting apparatus includes a number of loading/unloading posts, that have sliding mechanisms that slide along the longitudinal length of the posts as the platform is raised and lowered. The combination of the posts and sliding mechanisms retains the platform at the required height for installation and removal of the platform from a vehicle.

BRIEF DESCRIPTION OF THE DRAWINGS

In order to show manner in which the above recited and other advantages and objects of the invention are obtained, a more particular description of the invention briefly described above will be rendered by reference to specific embodiments thereof that are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

The present invention relates to a lifting apparatus and related methods to provide an individual with greater working height and ease of access. The lifting apparatus easily attaches to a vehicle, such as a pickup truck, while being simple to extend and retract from the bed. Additionally, the lifting apparatus of the present invention may be installed on a vehicle without the need for traditional installation apparatus, such as cranes, forklifts, or the like. The lifting apparatus includes a platform that carries various loads to allow an individual to lift equipment and materials to various heights. Furthermore, the lifting apparatus of the present invention includes various connecting mechanisms to connect the lifting apparatus to the vehicle in a simple and quick manner, thereby reducing installation cost and time. Additionally, the combination of the connecting mechanism and the structure of the lifting apparatus creates a stable platform from which individuals may work. The lifting apparatus of the present invention fulfills the desired load bearing, surface area, and height requirements for effective lifting of individuals, materials, tools, and other equipment.

Generally, the lifting apparatus of the present invention shall be described hereinafter with reference to installation and use within a pickup truck bed. The discussion contained herein should not be considered as limiting the applicability of the general principles of the invention to other types of vehicles or to those situations where the lifting apparatus is used from the ground.

Figure 1:
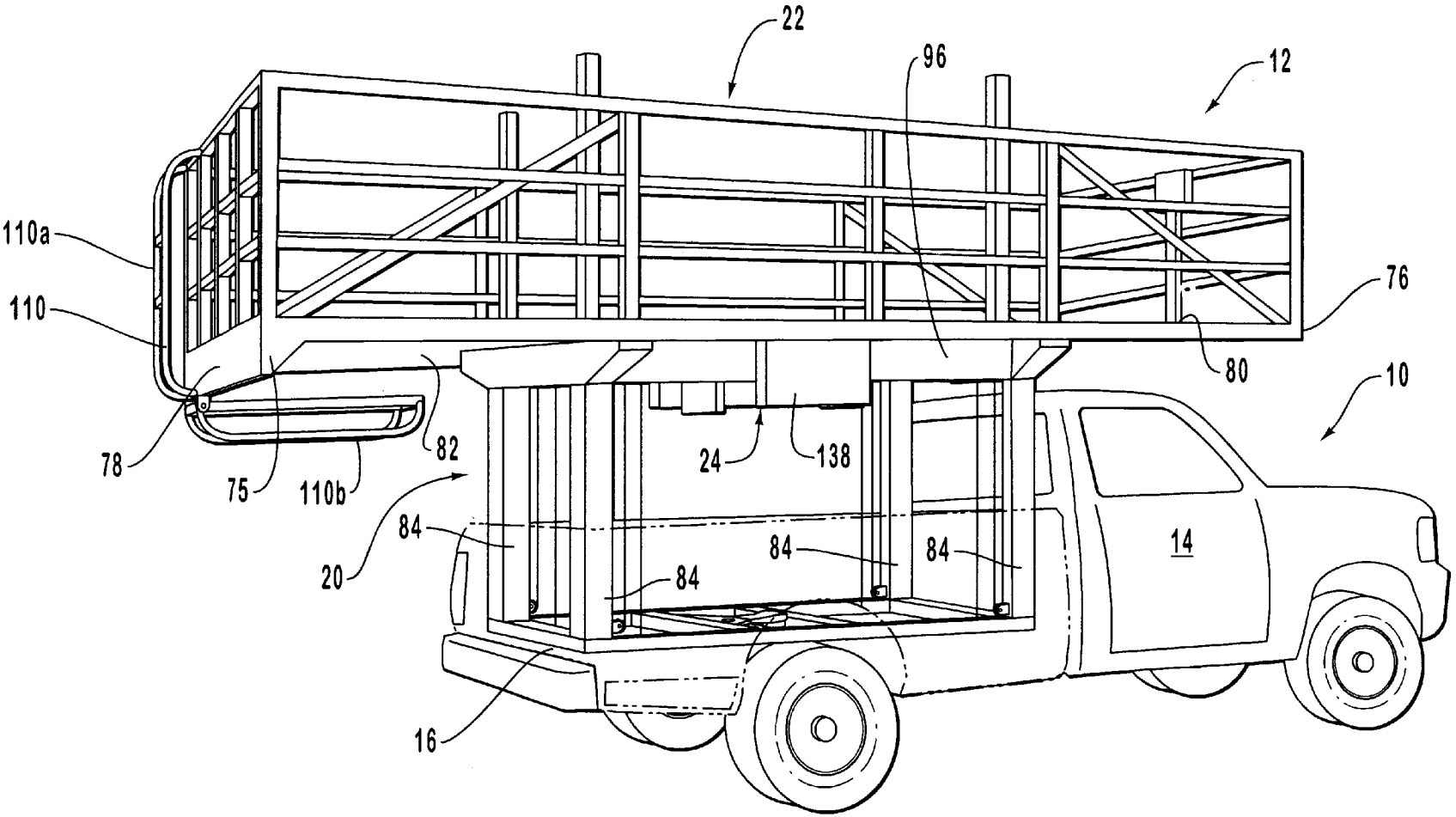
FIG. 1 is a partial breakaway perspective view of one embodiment of a vehicle with one embodiment of the lifting apparatus of the present invention.

Referring now to FIG. 1, a vehicle 10 is depicted that may support a lifting apparatus 12. Vehicle 10 includes a cab 14 and a vehicle bed 16 mounted to a frame 18. Bed 16 is adjacent to cab 14 and is configured to receive lifting apparatus 12 therein. Numerous types of vehicle 10 may utilize the beneficial characteristics of lifting apparatus 12 of the present invention, such as by way of example and not limitation, flat bed trucks, full-sized trucks, trailers, or the like.

Figures 2A, 2B:
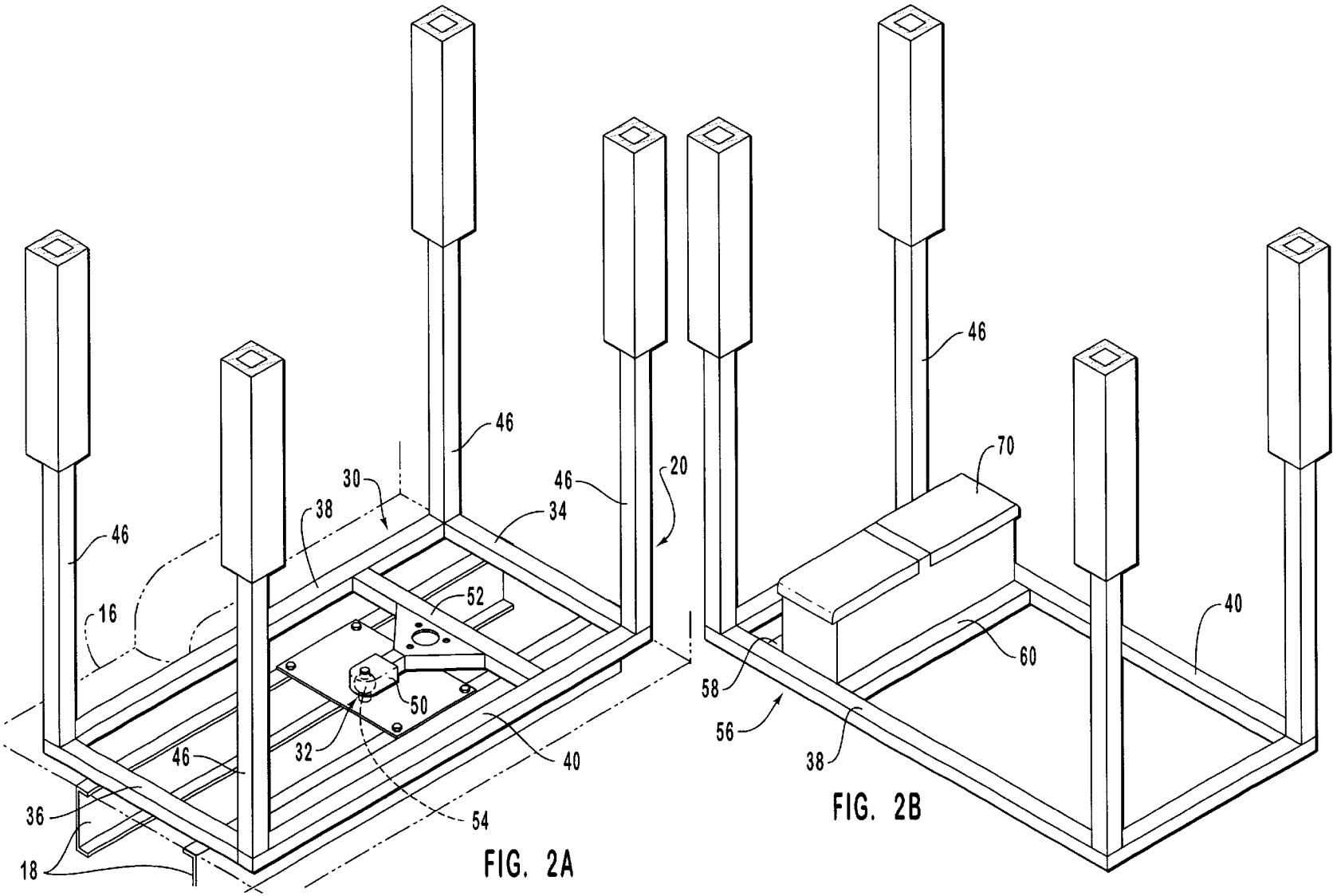
FIGS. 2A and 2B are perspective views of different embodiments of the base of the lifting apparatus of FIG. 1.

As shown in FIG. 1, lifting apparatus 12 includes a base assembly 20, a platform assembly 22, and a driving mechanism 24. FIG. 2A depicts base assembly 20 that is shown as having a generally square or rectangular base 30 with a plurality of columns 46 and a connecting mechanism 32. Base 30 includes a front element 34 separated from a rear element 36. Front and rear elements 34, 36 are spaced apart by two side elements; first side element 38 and second side element 40, that extend from respective ends of front and rear elements 34, 36. It may be appreciated by one skilled in the art, however, that base 30 may include more than two side elements 38, 40 to give additional structural support to base 30. For example, base 30 may include a plurality of side elements 38, 40, which are spaced from each other along the respective longitudinal lengths of front and rear elements 34, 36. In another configuration, side elements 38, 40 extend from front and rear elements 34, 36 at locations different from the ends thereof In still yet another configuration, side elements 38, 40 extend from opposite ends of front and rear elements 34, 36 to form a generally X-shaped configuration. Similarly, base 30 may utilize one or more additional elements that are spaced between front element 34 and rear element 36. Preferably, the additional elements are parallel to front and rear elements 34, 36. Additionally, though base 30, and therefore base assembly 20, is depicted as being generally rectangular, it can be appreciated by one skilled in the art that various other configurations of base 30 are possible, so that the coupling of elements 34, 36, 38, and 40, may vary.

Extending from base 30 are columns 46. As depicted in FIG. 2A, columns 46 extend from the junctions between front element 34 or rear element 36 and side elements 38, 40. It should be appreciated, however, that columns 46 may extend from base 30 at any location along front element 34, rear element 36, or side elements 38, 40. For example, columns 46 may connect solely with front and rear elements 34, 36, solely with side elements 38, 40, or with any combination of elements 34, 36, 38, 40.

Columns 46 define the maximum height that lifting apparatus 12 may reach, i.e., the longer columns 46, the greater the achievable height. The maximum height and therefore the length of columns 46 may be varied as necessary to provide a platform assembly 22 capable of raising to a desired height. However, the maximum height may be limited by a combination of the stability requirements of vehicle 10 with lifting apparatus 12 attached thereto and the legally allowable transportation height for such vehicles traveling on a highway. One skilled in the art can readily determine the appropriate length of columns 46 based on the above considerations.

Although four columns 46 are depicted in FIG. 2A, one skilled in the art, may identify various other configurations of columns 46 that may be used. For example, in another configuration base assembly 20 may include at least one column 46, where column 46 is configured to support the entire load of platform assembly 22 and accompanying equipment, materials, and individuals. In another configuration, columns 46 include support members that extend from the sides of columns 46 and fasten to front element 34, rear element 36, and/or side elements 38, 40 of base 30. In another configuration, column 46 includes stabilizers to provide additional stability to lifting apparatus 12 when platform assembly 22 is in the elevated position. In addition, although four columns 46 are depicted in the Figures, additional columns can be used, if desired.

Generally, base 30 and columns 46 may be fabricated from various types and configurations of elements having suitable mechanical strength and stability, such as thin wall tube, thick wall tube, solid members, or the like. Additionally, the cross sectional configuration of each element of base 30 and each column 46 may be different, such as for example and not by limitation, oval, trapezoidal, rectangular, or the like, or combinations thereof.

Base 30 and columns 46 may be composed of various types of materials, such as metals, composites, plastics, or the like, so long as the material used is capable of providing sufficient strength and support to the other components of the present invention. The materials recited herein are illustrative of the types of materials that may be used and should not be considered limiting.

Referring again to FIG. 2A, extending between side elements 38, 40 is connecting mechanism 32. As shown, connecting mechanism 32 includes a coupler 50 having a connector support 52 that positions coupler 50 between side elements 38, 40 and a complementary hitch ball 54, shown in dotted lines, attached to bed 16 and to frame 18 of vehicle 10. Coupler 50 may take various configuration as known by one skilled in the art, such as but not limited to one or more trailer hitches for different configurations of hitch ball 54. For example, one type of trailer hitch is the Bull Dog™ hitch. Similarly, hitch ball 54 may have various configurations so long as it is capable of attaching to vehicle 10 and aiding with the secure retention of lifting apparatus 12. For example, hitch ball 54 may be a solid hitch ball, a folding hitch ball, or some other hitch ball.

In use, coupler 50 attaches to hitch ball 54 and is locked in place. Upon coupling of coupler 50 to hitch ball 54, base 30 is securely retained to vehicle 10, and more specifically, to frame 18 of vehicle 10. As discussed herein, the terminology of attaching lifting apparatus 12 to bed 16 of vehicle 10 refers to lifting apparatus 12 being attached solely to bed 16 of vehicle 10, to bed 16 and frame 18 of vehicle 10, and any other attachment configuration known by one skilled in the art.

Generally, connecting mechanism 32 is one structure capable of performing the function of connecting means for securely attaching lifting apparatus 12 to vehicle 10. It can be appreciated by one skilled in the art, that various other embodiments of connecting means are possible. For example, in another configuration not shown, connecting means includes a plurality of feet that are fixably attached to or integrally formed with side elements 38, 40, front element 34, and/or rear element 36 of base 30. The feet allow base 30 to be attached or connected to appropriate corresponding fasteners that extend into bed 16 of vehicle 10, while providing the necessary structure to allow base 30 to be leveled and accurately positioned within bed 16. In another embodiment, connecting means includes a plurality of fasteners affixed to frame 18 of vehicle 10 that engage with complementary fastener holes formed in base 30. In another configuration, first side element 38 and second side element 40 are each adapted with sliding elements having a generally U-shaped form that cooperate with a complimentary groove or sliding rail formed in or on bed 16 of vehicle 10, and may optionally connect with frame 18. As base 30 is located within bed 16 of vehicle 10, the U-shaped element and the complimentary channel or sliding rails engage to prevent movement of base 30 relative to bed 16 and frame 18. In yet another configuration, base 30 is bonded, glued, welded, affixed, or otherwise attached to bed 16 of vehicle 10 and/or to frame 18.

Referring now to FIG. 2B, base 30 may optionally include an equipment rack 56 disposed between first side element 38 and second side element 40. Equipment rack 56 has a front rack member 58 and a rear rack member 60 that are disposed between first side element 38 and second side element 40 of base 30. The combination of front and rear rack members 58, 60 with side elements 38, 40 creates a recessed area, within which equipment, such as a tool box 70 (FIG. 2B), oxyacetylene tanks, or the like may be safely carried.

Generally, equipment rack 56 may be integrally fabricated with base 30 of base assembly 20 or separately fabricated and attached to base 30 through conventional fixation methods and apparatus, such as nut and bolts, welds, adhesives, rivets, or the like. In another embodiment, equipment rack 56 is configured for a specific piece of equipment, such as oxyacetylene tanks or a truck mountable toolbox 70.

It may be appreciated that one skilled in the art may identify various other configurations of equipment rack 56. For example, equipment rack 56 may include a plurality of L-shaped brackets that connect to form the recessed area. In another configuration, equipment rack 56 is fabricated from a number of tubular members that form the recessed area. In yet another configuration, no recessed area is formed.

Referring again to FIG. 1, platform assembly 22 is depicted. Platform assembly 22 has a generally planar platform 75, having a first end 76 that extends over cab 14 of vehicle 10 and a second end 78 that extends over the rear of vehicle 10. Platform 75 further includes a lower surface 82 and an upper surface 80. Extending from lower surface 82 of platform 75 is one or more hollow outer column receivers 84 that cooperate with columns 46. As such, outer column receivers 84 are configured to allow sliding engagement of columns 46 within the interior of outer column receivers 84, though it may be appreciated that guide receivers 84 may be configured to slidably engage with the interior of columns 46.

Figure 3:
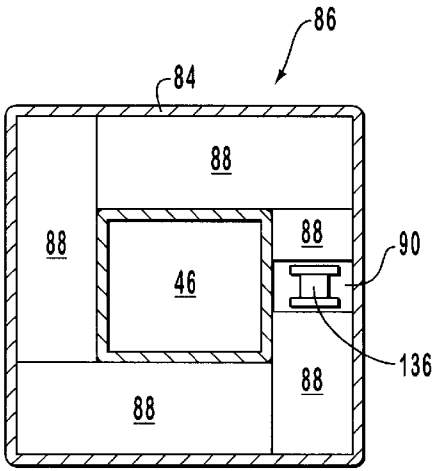
FIG. 3 is a cross-sectional view of the sliding engagement of a column and an outer column receiver of the lifting apparatus of FIG. 1.

As shown better in FIG. 3, each outer column receiver 84 has a generally square cross-section. Various other cross-sectional configurations of outer column receiver 84, however, are appropriate so long as the particular configuration allows cooperation of columns 46 with outer column receivers 84. Columns 46 and outer column receivers 84 should preferably securely cooperate so that undesired movement transverse to the sliding motion of columns 46 within outer column receivers 84 is eliminated. One way to reduce transverse movement is through inner column guide 86. As shown, inner column guide 86 includes a number of inner column guide blocks 88 that substantially surround column 46 and extend the length of outer column receivers 84; however, inner column guide blocks 88 need not extend the full length of outer column receivers 84, but may extend along only a portion of each outer column receiver 84. Inner column guide blocks 88 as shown in FIG. 3, leave an annulus 90 to allow driving mechanism 24 to engage with an upper most portion of column 46; however, inner column guide 86 may completely surround column 46 and may be configured as a single element rather than from multiple inner column guide blocks 88. It can be appreciated by one skilled in the art that various other structures and methods are appropriate for securely engaging columns 46 with outer column receiver 84. Additionally, it may be appreciated that the function and operation of lifting apparatus 10 may be accomplished without securely engaging columns 46 with outer column receivers 84.

Generally, inner column guide 86 may be fabricated from various types of material ranging from plastics, composites, metals, combinations thereof, or other suitable materials. It is preferable that inner column guide 86 be substantially composed of a plastic material.

Figure 4:
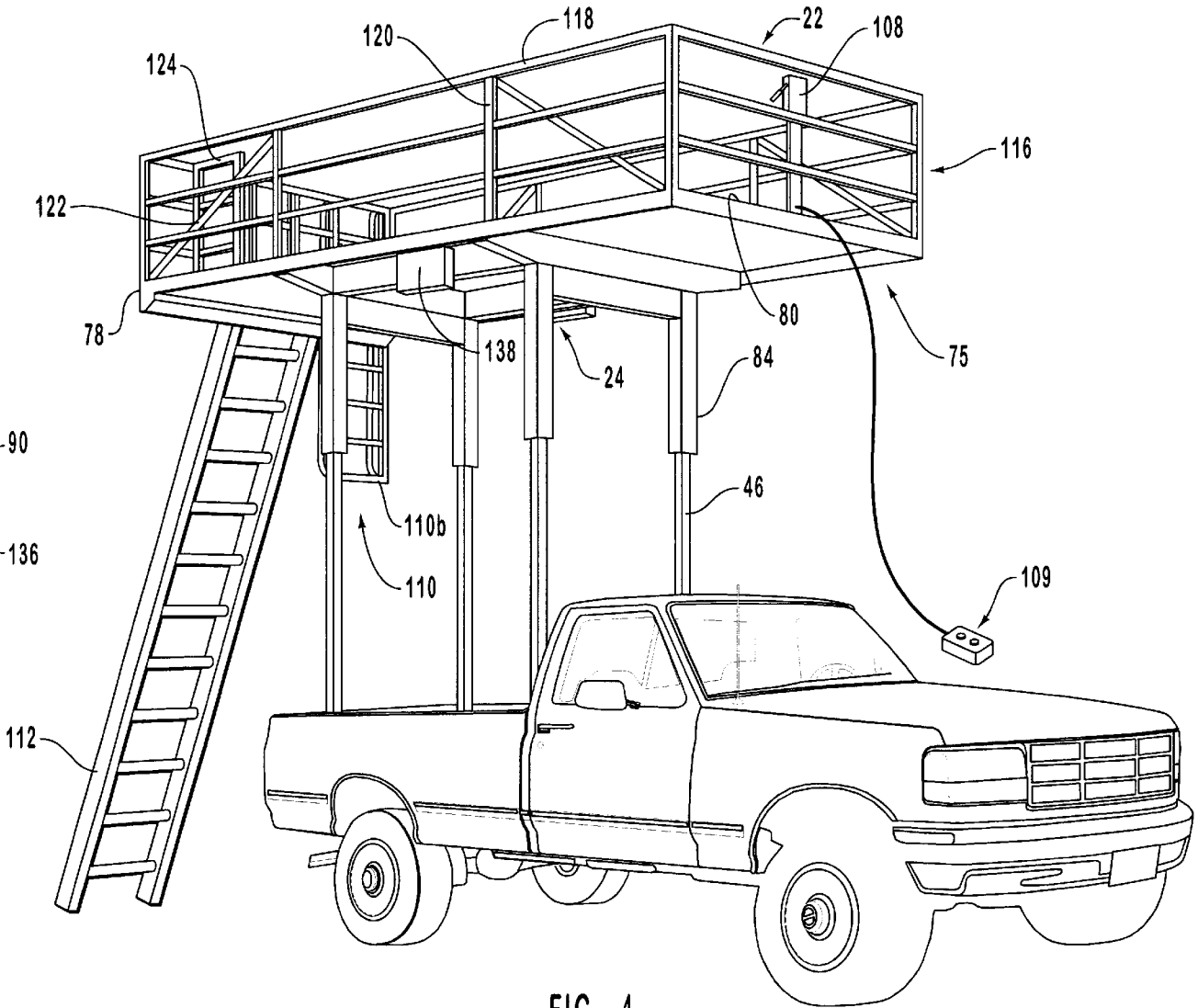
FIG. 4 is a partial breakaway perspective view of the lifting apparatus of FIG. 1 in an extended or raised position.

Referring now to FIG. 4, platform assembly 22 includes a control pedestal 108 attached to upper surface 80 of platform 75. Control pedestal 108 includes the requisite electronic components and controls to activate and deactivate driving mechanism 24, thereby raising, and lowering platform 75 of platform assembly 22 along columns 46. Additionally, control pedestal 108 may optionally include a handheld remote 109, such that lifting apparatus 12 may be activated from ground level. As such, handheld remote 109 may communicate with control pedestal 108 or directly with driving mechanism 24 in various other manners, such as but not limited to, by way of a radio signal, infrared or microwave signal, or some other signal or manner known by one skilled in the art. One skilled in the art may further identify various other configurations of control pedestal 108 and handheld remote 109 that are capable of performing the desired function. For example, control pedestal 108 may be manually operable.

Referring now to FIGS. 1 and 4, platform assembly 22 includes a ladder 110. As shown in FIG. 1, ladder 110 is attached to lower surface 82 at second end 78 of platform 75. Ladder 110 has a lower portion 110*b* that is stored in a generally parallel orientation to lower surface 82 below platform 75, but may be swung from the storage position to be substantially parallel to an upper portion 110*a* of ladder 110, i.e., oriented vertically as shown in FIG. 4. By swinging lower portion 110*b* to a vertical position, an individual may gain access to upper surface 80. Additionally, ladder 110 may cooperate with a detachable secondary ladder 112 that allows an individual to conveniently access upper surface 80 of platform 75 when platform 75 is in the extended position.

It can be appreciated that one skilled in the art may identify various other embodiments of ladder 110. For example, ladder 110 may be detachable. In another configuration, platform 75 includes multiple ladders 110. In yet another configuration, ladder 110 may be extendable to reach the ground or other surface upon which platform 75 is placed, even if platform 75 is in a raised position. In still yet another configuration, ladder 110 is attached to another portion of platform 75.

In a preferred embodiment, platform assembly 22 includes a railing assembly configured to enhance the safety of individuals working on or around lifting apparatus 12. Thus, as shown in FIG. 4, platform assembly 22 includes a railing assembly 116 that extends from upper surface 80 of platform 75 and has a number of generally horizontal members 118, generally vertical members 120, and optional bracing members 122 that combine to create a fence type structure. Members 118, 120, 122 are attached to each other and to platform 75 to act as a safety barrier to prevent individuals and materials from falling or sliding off platform 75. As such, railing assembly 116 is shown as fixed to platform 75. In another configuration, however, railing assembly 116 may be fabricated from various sectional assemblies that are detachably attached to platform 75. Therefore, portions of railing assembly 116 may be fixed or detachably coupled to platform 75. In yet another configuration, platform assembly 22 does not include a railing assembly 116.

As shown in FIG. 4, located at second end 78 of platform assembly 22 is a gate 124 formed in railing assembly 116. Gate 124 allows an individual access to upper surface 80 of platform 75. Gate 124 is depicted as being a double gate, however, one skilled in the art can identify various other embodiments of gate 124 that are applicable. For example, a single gate, a sliding gate, a removable gate, or the like.

Generally, platform assembly 22 may take various different configurations that are known by one skilled in the art, so long as platform assembly 22 is capable of cooperating with base assembly 20 and driving mechanism 24. Platform assembly 22 may be fabricated from various types of material such as, for example and not by limitation, metals, composites, plastics, or the like, or combinations thereof. It is preferred that platform assembly 22 may be substantially composed of aluminum.

Figure 5:
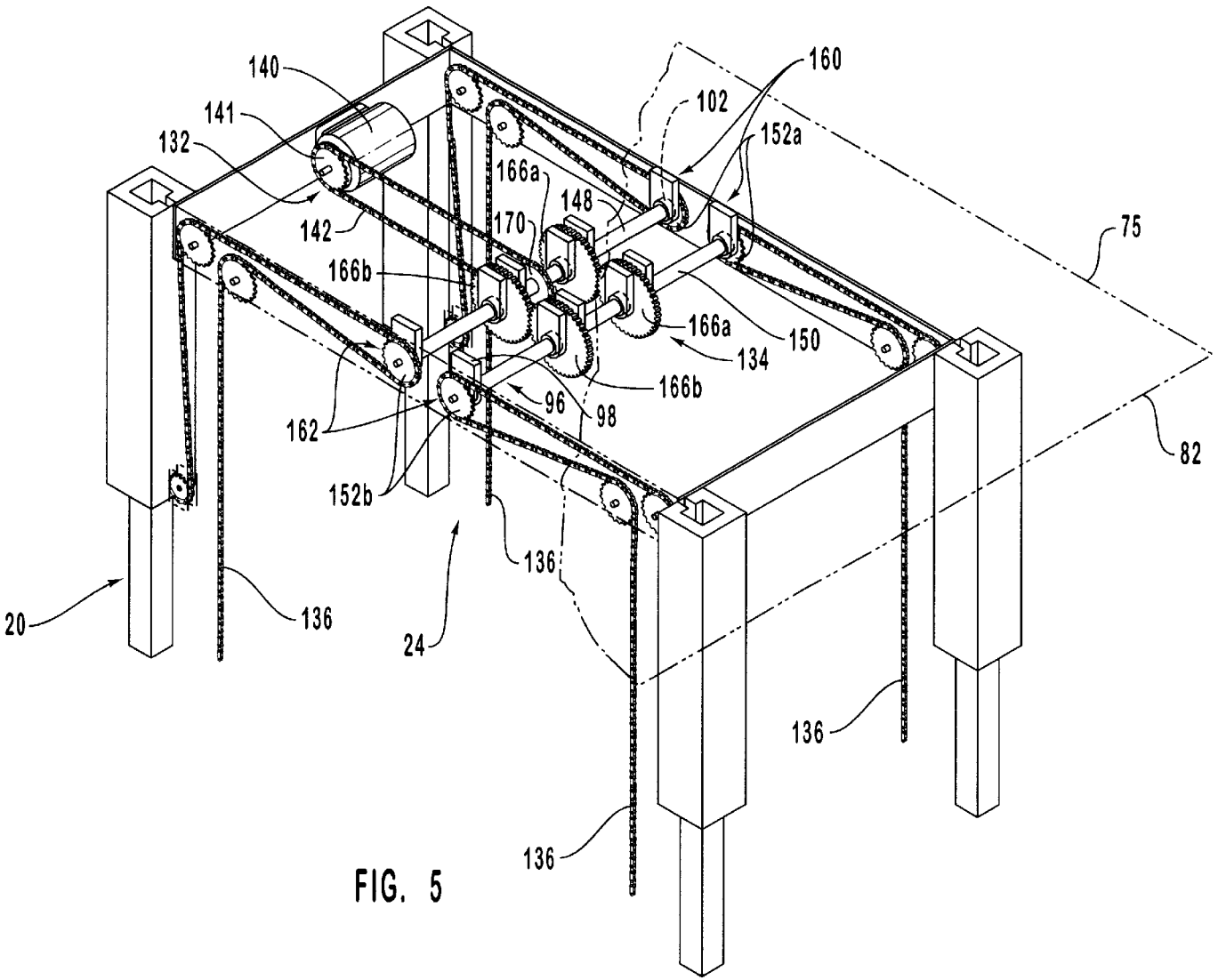
FIG. 5 is a partial breakaway perspective view of one embodiment of a driving mechanism and structure of the lifting apparatus of FIG. 1.

Referring now to FIG. 5, extending from lower surface 82 of platform 75 (depicted by the dotted lines) is a mounting structure 96 that allows driving mechanism 24 to be mounted to platform 75. As depicted, mounting structure 96 includes one or more flanges 98 that are coupled to lower surface 82 of platform 22. Each flange 98 includes a mounting hole (not shown) located at a distal end thereof, with a bearing 102, shown in dotted lines, attached therein. The mounting hole and bearing 102 are capable of cooperating with the components of driving mechanism 24 to allow free rotation of driving mechanism 24, while securely maintaining driving mechanism 24 in place.

Generally, mounting structure 96 is one structure capable of performing the function of mounting means for coupling driving mechanism 24 to platform assembly 22. It may be appreciated that one skilled in the art may identify various other configurations of mounting structure 96 that are capable of performing the function thereof. For example, the mounting holes may be tapered to cause a friction fit with driving mechanism 24. In another configuration, the mounting holes may be devoid of bearings 102. In yet another embodiment of mounting structure 96, the mounting holes may include protrusions that cooperate with bushings to allow free rotation of driving mechanism 24. In still yet another embodiment of mounting structure 96, the mounting holes may have the configuration of a slot.

According to FIG. 5, attached to mounting structure 96 and cooperating with base assembly 20 is driving mechanism 24. Driving mechanism 24 is adapted to raise and lower platform 75 relative to base assembly 20, or vice versa, depending on whether lifting apparatus 12 is to be loaded or unloaded. The embodiment of driving mechanism 24 depicted in FIG. 5 includes a motor assembly 132, a gear assembly 134, and one or more lifting chain 136. As shown portions of driving mechanism 24 are contained within a housing 138 (shown better in FIGS. 1 and 4) that protects the various components thereof. It can be appreciated that driving mechanism 24 may operate with or without housing 138.

Motor assembly 132 includes a motor 140 and a linking chain 142. Motor 140 provides the necessary rotational motion, power, and torque to raise platform assembly 22 relative to base assembly 20. Motor 140 is depicted as an electric motor that has a gear 141; however, various other types of motor 140 are applicable to the present invention. For example, and not by limitation, oil, gas, diesel, pneumatic, hydraulic, or the like, motors are applicable.

Linking chain 142 extends between gear 141 of motor 140 and gear assembly 134. As gear 141 rotates, linking chain 142 translates the rotational motion of gear 141 to gear assembly 134 to cause displacement of platform assembly 22 as described more fully below. As such, linking chain 142 may have various configurations so long as it is capable of performing the required function. For example, linking chain 142 may be a belt, or the like and may be fabricated from various types of material such as metals, plastics, composites, or the like.

Cooperating with and rotatably engaged with motor assembly 132 is gear assembly 134. Gear assembly 134 includes two jack shafts: a first jack shaft 148 and a second jack shaft 150. Jack shafts 148, 150 are mounted to platform assembly 22 by way of mounting structure 96 and bearings 102, described previously. Each jack shaft 148, 150 may be mounted to platform assembly 22 in other appropriate manners, depending on the particular configuration of mounting structure 96.

Attached to first jack shaft 148 is a primary drive coupler 170. Primary drive coupler 170 connects with linking chain 142 of motor assembly 132 to allow motor assembly 132 to rotate first jack shaft 148. The configuration of primary drive coupler 170 may vary as necessary depending on the particular type of linking chain 142 and motor 140. For example, the number of teeth, the diameter of primary drive coupler 170, and the like may vary. Additionally, primary drive coupler 170 need not include teeth or the like but may create engagement between motor assembly 132 and gear assembly 134 through friction contact or a plurality of intermediate gears or sprockets.

Each jack shaft 148, 150 has a first end 160 and a second end 162. Substantially disposed at first end 160 of each jack shaft 148, 150 is a first jack shaft sprocket 152*a*, while disposed at each second end 162 is a second jack shaft sprocket 152*b*. Each jack shaft sprocket 152*a*, 152*b* is configured to rotatably engage with lifting chain 136 to thereby translate rotational motion of each jack shaft 148, 150 to lifting chain 136. As such, each jack shaft sprocket 152*a*, 152*b* includes a number of teeth that are configured to engage with lifting chain 136. The configuration of each jack shaft sprocket 152*a*, 152*b* may vary based on the specific configuration of lifting chain 136, for example and not by way of limitation, the number and configuration of the teeth of jack shaft sprockets 152*a*, 152*b* may vary depending on lifting chain 136 and the rate at which platform assembly 22 is to be raised. In another configuration, if lifting chain 136 is a wire or belt rather than a chain, jack shaft sprockets 152*a*, 152*b* may have a different engagement, such as friction fit, rollers, and tensions springs, or the like.

Disposed between first and second ends 160, 162 of jack shafts 148, 150 are two complementary spur gears 166*a*, 166*b*. Spur gears 166*a*, 166*b* allow the rotational motion of jack shafts 148, 150 induced by motor assembly 132 to be translated to jack shaft sprockets 152*a*, 152*b*. As such, spur gear 166*a* of first jack shaft 148 engages with spur gear 166*a* of second jack shaft 150 and causes second jack shaft 150 to rotate in the opposite direction to that of first jack shaft 148. Likewise, spur gear 166*b* of first jack shaft 148 engages with spur gear 166*b* of second jack shaft 150 and causes second jack shaft 150 to rotate in the opposite direction to that of first jack shaft 148. It is preferred that spur gears 166*a*, 166*b* be substantially identical to induce equal rotation of jack shafts 148, 150 to thereby raise and lower platform assembly 22 at the same rate and prevent binding and damage to columns 46 and outer column receivers 84. It can be appreciated, however, that the configurations of each spur gear 166*a*, 166*b* may be different or otherwise vary as required by one skilled in the art. Additionally, it may be appreciated that one skilled in the art may identify various other embodiments of jack shafts 148, 150 and the associated sprockets 152*a*, 152*b* and spur gears 166*a*, 166*b* are applicable. For example, each jack shaft may include only a single spur gear 166*a* to translate the rotational motion of motor assembly 132 to jack shaft sprockets 152*a*, 152*b*. In another configuration, only a single jack shaft 148 is used, while additional gears and sprockets are included to cause the necessary translation of motion.

Engaging with each jack shaft sprocket 152 is lifting chain 136. As depicted, four lifting chains 136 are used to raise and lower platform assembly 22; however, the present invention may utilize various numbers of lifting chains 136 depending on the particular configuration of lifting apparatus 12. As such, reference shall be made hereinafter to only one lifting chain 136 although it will be appreciated that the same discussion may be made with respect to each lifting chain 136.

Figure 6:
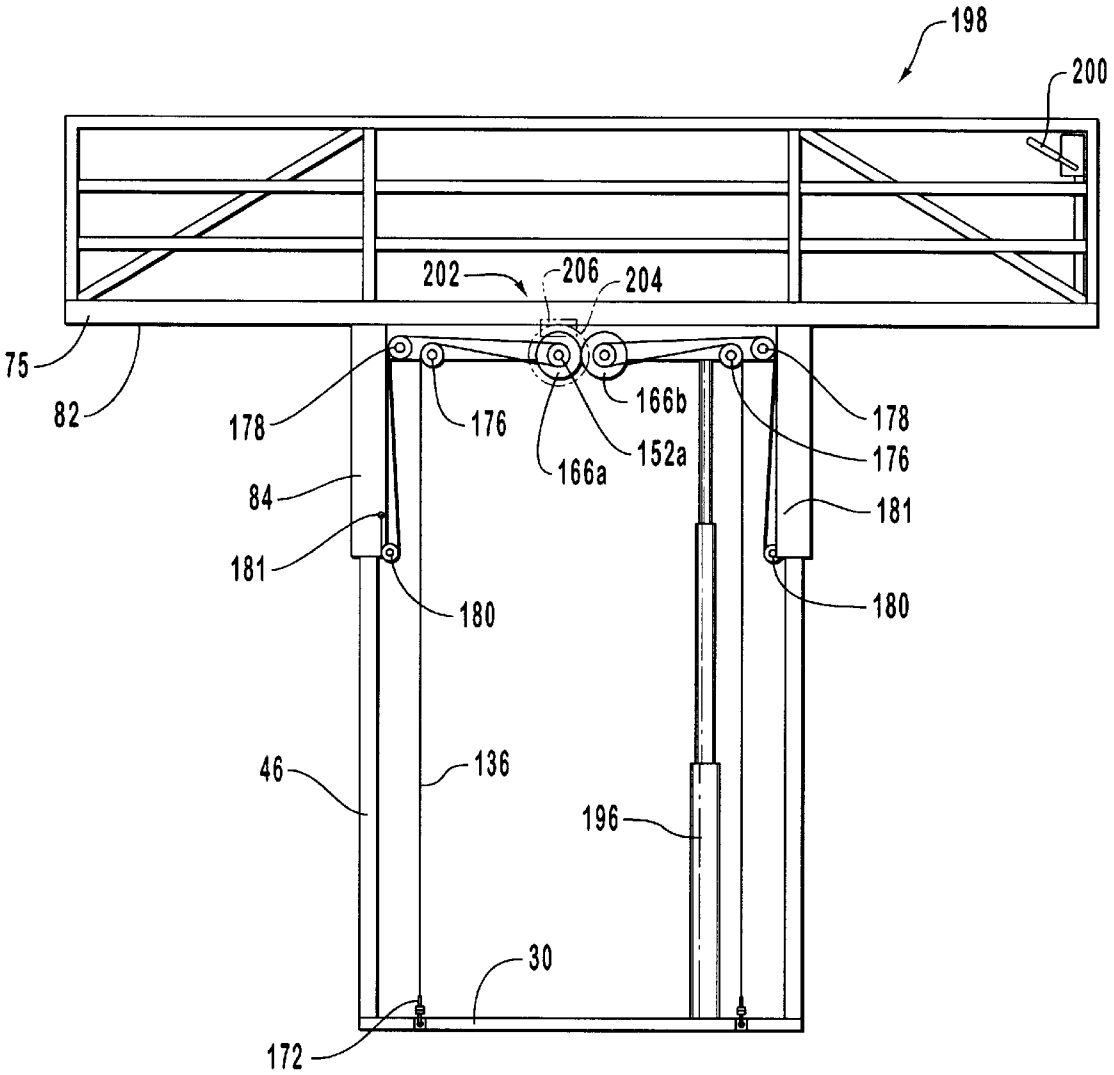
FIG. 6 is a cross-sectional side view of the lifting apparatus of FIG. 1.

As depicted in FIG. 6, lifting chain 136 attaches to base 30 by way of an adjustment mechanism 172, such as a double nut bolt, or similar device known by one skilled in the art to adjust the length and tension of lifting chain 136. Lifting chain 136 extends from base 30 to a first idler sprocket 176 positioned adjacent to the junction of outer column receiver 84 with lower surface 82 of platform 75. Lifting chain 136 engages with the teeth of first idler sprocket 176 and passes to jack shaft sprocket 152*a*. Lifting chain 136 partially surrounds jack shaft sprocket 152*a* before traversing to second idler sprocket 178, located near to first idler sprocket 176. From second idler sprocket 178, lifting chain 136 tracks the length of outer column receiver 84 to engage with third idler sprocket 180. Lifting chain 136 extends from third idler sprocket 180 through anulous 90 in inner column guide 86 (FIG. 3) a terminal point 181 upon an upper most portion of column 46. Idler sprockets 176, 178, 180 provide tension control and direction control for lifting chain 136, and as such each idler sprocket 176, 178, 180 may have various configurations such that they securely engage with lifting chain 136.

Driving mechanism 24, as depicted herein, is only one embodiment of the type of driving mechanism 24 that is capable of lowering and raising platform assembly 22 in a controlled manner. Additionally, driving mechanism 24 is one structure capable of performing the function of driving means for reversibly elevating platform assembly 22 relative to base assembly 20. Various other embodiments of driving mechanism 24 and driving means are known by one skilled in the art. For example, driving means may include a plurality of hydraulic rams that lower and raise platform assembly 22 in a controlled manner. In another alternative configuration, driving means includes a plurality of pulleys that rotatably engage with connecting wires that couple between platform assembly 22 and base assembly 20. In yet another configuration, columns 46 are formed with a plurality of racks that engage with a plurality of complementary pinions formed in outer column receivers 84 of platform assembly 22. Thereby, rotational motion of the pinions causes platform assembly 22 to rise or fall. In yet another configuration, driving means may incorporate elements of various types of conventional driving mechanisms, such as rack and pinions with hydraulic rams, lifting chains with hydraulic rams, pulleys with rack and pinions, or any other combination.

As depicted in FIG. 6, the present invention may optionally include a hydraulic ram 196 and a brake assembly 198. Hydraulic ram 196 extends from lower surface 82 of platform 75 to base 30 of base assembly 20. Hydraulic ram 196 extends and retracts simultaneously with the lifting and lowering of platform 75 relative to base 30 and is adapted to slowly lower platform 75 in the event that gear assembly 134, lifting chain 136, or motor assembly 132 fails. As such, hydraulic ram 196 is one structure capable of performing the function of safety means for controlling the descent of platform assembly 22 relative to base assembly 20 in the event of a malfunction of lifting apparatus 12.

The present invention may optionally include a brake assembly 198, that functions as safety means, that may combine with or function independently from hydraulic ram 196. Brake assembly 198 includes an activation handle 200 disposed in close proximity to control pedestal 108 and a disk brake assembly 202 having a brake disk 204, a caliper 206, and two brake pads (not shown). Brake disk 204 is mounted on first jack shaft 148 in close proximity to spur gear 166*a* and primary drive coupler 170. Alternatively, brake disk 204 may be located at any longitudinal position along either first or second jack shaft 148, 150. Caliper 206 surrounds a portion of brake disk 204 and is adapted to force the brake pads against disk brake 204 when handle 200 is activated. Specifically, since caliper 206 fluidly communicate with handle 200 by way of a brake line (not shown). As handle 200 is moved, the fluid within the fluid line is pressurized thereby forcing the brake pads against disk brake 204 to prevent rotational movement of first jack shaft 148, thereby preventing movement of platform 75.

Figure 7:
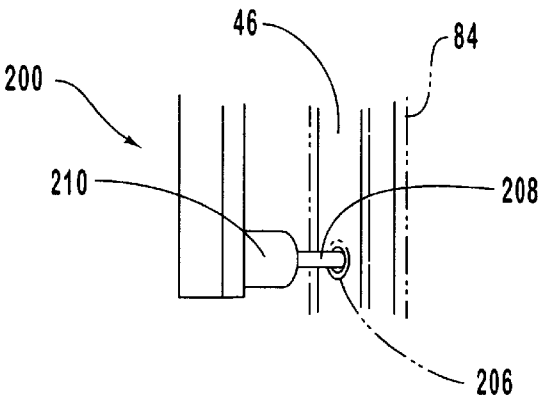
FIG. 7 is a partial perspective view of one alternate embodiment of a safety means of the lifting apparatus of FIG. 1.

Another embodiment of safety means is depicted in FIG. 7. As shown, column 46 and outer column receiver 84 are adapted with holes 206 that cooperate with securing pins 208. Each securing pin 208 is activated by a solenoid 210 that has an "off" state and an "on" to state to allow solenoid 210 to engage with and release pins 208 during raising and lowering of platform assembly 22. As platform 75 is raised, therefore, solenoid 210 is "on" to withdraw pin 208 from one hole 206 and changes to the "off" state to release pin 208 such that pin 208 is inserted within the next hole 206 as platform 75 rises. Solenoid 210 and pin 208 thereby prevent the uncontrolled lowering of platform 75 in the event of malfunction or failure of lifting apparatus 12. Additionally, solenoid 210 is adapted such that in the event of failure of solenoid 210, the "off" state retains pin 208 within hole 206. One skilled in the art may identify various other configurations of solenoid 210 and pins 208. For example, each column 46 and outer column receiver 84 may include solenoid 210 and pin 208.

It can be appreciated that one skilled in the art may identify various other embodiments of safety means that are appropriate in controlling the lowering and raising of platform assembly 22. For example, motor 140 of motor assembly 132 may include an internal brake that is sufficient to prevent lowering of platform 75 in the event of the malfunction or breakage of any portion of lifting apparatus 12.

Figure 8:
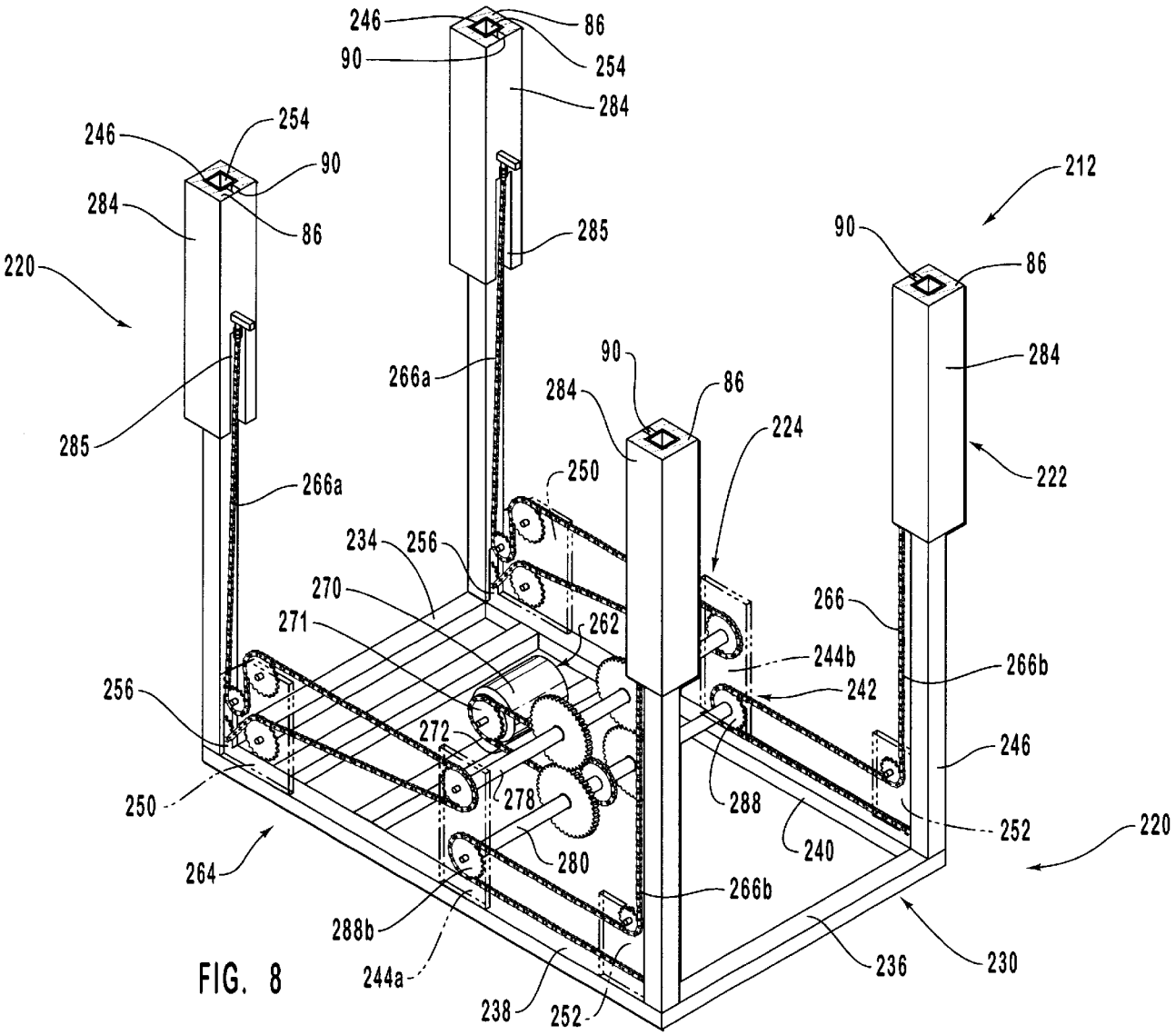
FIG. 8 is a partial perspective view of an alternate embodiment of the lifting apparatus of the invention.
Figure 9:
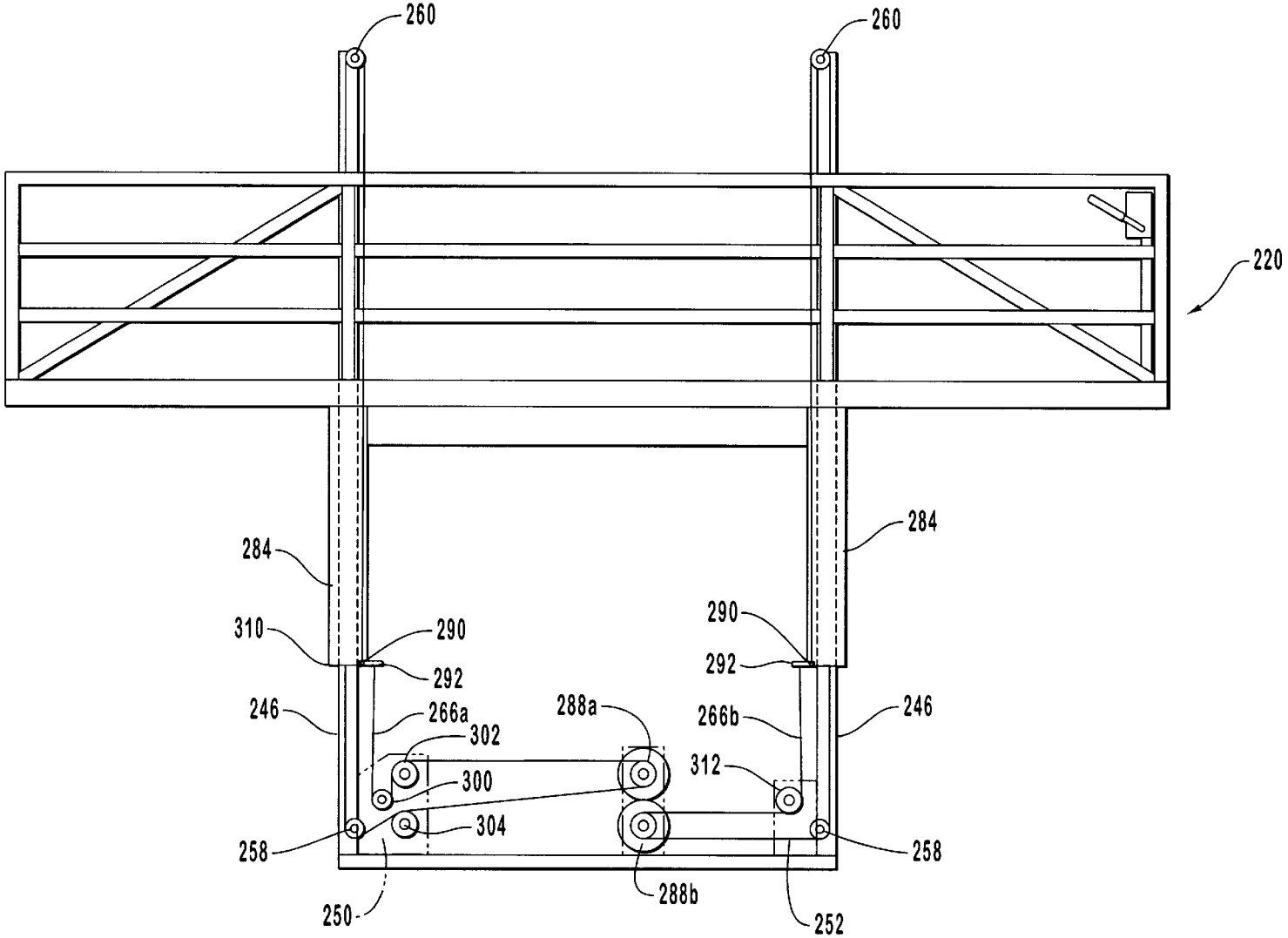
FIG. 9 is a cross-section side view of the lifting apparatus of FIG. 8.

Referring now to FIGS. 8 and 9, an alternate embodiment of a lifting apparatus 212 of the present invention is depicted. The majority of the features discussed with respect to lifting apparatus 12 also apply to lifting apparatus 212. Lifting apparatus 212 has a base assembly 220, a platform assembly 222, and a driving mechanism 224. Platform assembly 222 is similar to platform assembly 22; however, base assembly 220 has a different configuration to accommodate changes in the form of driving mechanism 224.

Referring now to FIG. 8, base assembly 220 has a generally square or rectangular base 230 with a plurality of columns 246, as previously discussed herein. Base 230 also includes a connecting mechanism to attach lifting apparatus 212 to vehicle 10; however, the connecting mechanism has been excluded from FIGS. 8 and 9 for ease of explanation of the various components of lifting apparatus 212.

Disposed on base 230 is a mounting structure 242 that is adapted to mount portions of driving mechanism 224 on base 230. As such, mounting structure 242 includes one or more mounting flanges 244*a*, 244*b* each having a plurality of holes and bearings (not shown) formed therein to allow driving mechanism 224 to securely attach thereto. It may be appreciated by one skilled in the art that various other configurations of mounting structure 242 are possible, so long as they are capable of securely retaining driving mechanism 224 to base 230.

Extending from base 230 are columns 246. As depicted, each column 246 extends from the junctions between front element 234 or rear element 236 and two side elements 238, 240. Each column 246 has a central channel 254 that extends along the longitudinal length of each column 246. Disposed at a proximal end of column 246, in close proximity to base 230, is a hole 256 that is configured to cooperate with driving mechanism 224. Additionally, each column 246 has an upper sprocket 258 and a lower sprocket 260 (shown in FIG. 9) disposed within or optionally without channel 254. Each sprocket 258, 260 is configured to engage with driving mechanism 224 as shall be discussed hereinafter.

Disposed in close proximity to front element 234 is a first gear plate 250, while disposed in close proximity to rear element 236 is a second gear plate 252. Each gear plate 250, 252 has a generally rectangular configuration and includes a number of holes with associated bearings (not shown) such that each gear plate 250, 252 is adapted to securely retain driving mechanism 224 to base 230. Additionally, each gear plate 250, 252 attaches to an adjacent side element 238, 240 of base 230 and an adjacent column 246. Furthermore, each gear plate 250, 252 is configured to slidably engage with a slit 285 formed in each outer column receiver 284 of platform assembly 220. As such, the configuration of each gear plate 250, 252 may vary so long as they are capable of cooperating with slit 285, while securely retaining the other components of driving mechanism 224 as discussed hereinafter. For example, each gear plate 250, 252 may have various other cross-sectional configurations, such as but not limited to, square, trapezoidal, triangular, octagonal, and various other configurations.

Generally, base 230, gear plate 250, 252, and columns 246 may be fabricated from various types and configurations of elements having suitable mechanical strength and stability, such as thin wall tubing, thick wall tubing, solid members, or the like. Additionally, the cross sectional configuration of each element of base 230, each gear plate 250, 252, and each column 246 may be different, such as for example and not by limitation, oval, trapezoidal, rectangular, or the like, or combinations thereof.

Base 230, gear plates 250,252, and columns 246 may be composed of various types of materials, such as metals, composites, plastics, or the like, so long as the material used is capable of providing sufficient strength and support to the other components of the present invention. The materials recited herein are illustrative of the types of materials that may be used and should not be considered limiting.

Cooperating with base assembly 220 and platform assembly 222 is driving mechanism 224. Driving mechanism 224 is located on base 230 by way of mounting structure 242 through the holes and bearings formed in flanges 244*a*, 244*b*. Driving mechanism 224 includes a motor assembly 262, a gear assembly 264, and one or more lifting chains 266.

Motor assembly 262 includes a motor 270 and a linking chain 272. Motor 270 provides the necessary rotational motion, power, and torque to raise platform assembly 222 relative to base assembly 220. Motor 270 is depicted as an electric motor that has a gear 271; however, various other types of motor 270 are applicable to the present invention, such as described previously herein.

Linking chain 272 extends between gear 271 of motor 270 and gear assembly 264. As gear 271 rotates, linking chain 272 translates the rotational motion of gear 271 to gear assembly 264 to cause displacement of platform assembly 22 as described more fully below. As such, linking chain 272 may have various configurations so long as it is capable of performing the required function, such as those described herein.

Engaged with motor assembly 262 is gear assembly 264. Gear assembly 264 has the same general configuration and functionality as previously described. As such, gear assembly 264 includes two jack shafts 278, 280 each having jack shaft sprockets 288*a*, 288*b* disposed at the ends thereof. Each jack shaft 278, 280 is mounted to base assembly 220 by way of mounting structure 242 as described previously. Additionally, gear assembly 264 includes a number of idler sprockets 300, 302, 304, and 312, shown in FIG. 9. Each idler sprocket 300, 302, 304, and 312 is mounted to a respective gear plate 250, 252 by way of holes and bearings (not shown) that allow free rotation thereof.

Referring now to FIG. 9, engaging with each jack shaft sprocket 288*a*, 288*b* is a first lifting chain 266*a* and a second lifting chain 266*b*. As depicted, two pairs of lifting chains 266*a*, 266*b* are used to raise and lower platform assembly 222; however, the present invention may utilize various numbers of lifting chain 266*a*, 266*b* pairs depending on the particular configuration of lifting apparatus 212. As such, reference shall be made hereinafter to only one pair of lifting chains 266*a*, 266*b* although it will be appreciated that the same discussion may be made with respect to each subsequent pair of lifting chain 266*a*, 266*b*.

As depicted in FIG. 9, lifting chain 266*a* attaches to outer column receiver 284 at a connecting point 290 by way of an adjustment assembly 292, such as a double nut bolt or other similar structure that allows the length of and tension of lifting chain 266*a*. Lifting chain 266*a* extends from a connecting point 290 to first idler sprocket 300 attached to first gear plate 250 that is in close proximity to the junction of column 246 and base 230. Lifting chain 266*a* engages with the teeth of first idler sprocket 300 and passes by second idler sprocket 302 to reach jack shaft sprocket 288*a*. Lifting chain 266*a* partially surrounds jack shaft sprocket 288*a* before traversing to third idler sprocket 304, located near to first and second idler sprockets 302, 304. The particular position and configuration of second and third idler sprockets 302, 304 allows lifting chain 266*a* to circumvent the wheel well formed in the bed of the vehicle when lifting apparatus 212 is placed within the bed of the vehicle. It may be appreciated that if vehicle 10 is devoid of a wheel well within the bed or if the wheel well does not extend sufficiently into the bed to interrupt the movement of lifting chain 266*a*, driving mechanism 224 need not include second and third idler sprockets 302, 304.

Referring now to FIGS. 8 and 9 together, from third idler sprocket 304, lifting chain 266*a* passes through hole 256 in one end of column 246 and engages with the teeth of lower sprocket 258 communicating with channel 254. Lifting chain 266*a* passes longitudinally along the length of column 246 within channel 254 and exits from the distal end thereof through the aid of upper sprocket 260. As lifting chain 266*a* exits from the distal end of channel 254, lifting chain 266*a* engages with the teeth of upper sprocket 260. Upper sprocket 260 directs lifting chain 266*a* through annulus 90 in inner column guide 86, shown in FIG. 8, to terminate at a terminal point 310 upon an inner surface of outer column receiver 284, at approximately the same longitudinal position as connecting point 290.

Lifting chain 266*b* also attaches to outer column receiver 284 at a connecting point 290 by way of an adjustment assembly 292. Lifting chain 266*b* extends from connecting point 290 to a fourth idler sprocket 312 positioned within second gear plate 252 that is in close proximity to the junction of column 246 and base 230. Lifting chain 266*b* engages with the teeth of fourth idler sprocket 312 and passes to partially surround jack shaft sprocket 288*b* before traversing to pass through hole 256 and engage with the teeth of lower sprocket 258 communicating with channel 254. Lifting chain 266*b* tracks the length of column 246 to exit from the distal end thereof. As lifting chain 266*b* exits from the distal end of channel 254, lifting chain 266*b* engages with the teeth of upper sprocket 260 in a similar manner as described previously. Upper sprocket 260 directs lifting chain 266*b* to a terminal point 310 through annulus 90 in inner column guide 84.

Figure 10:
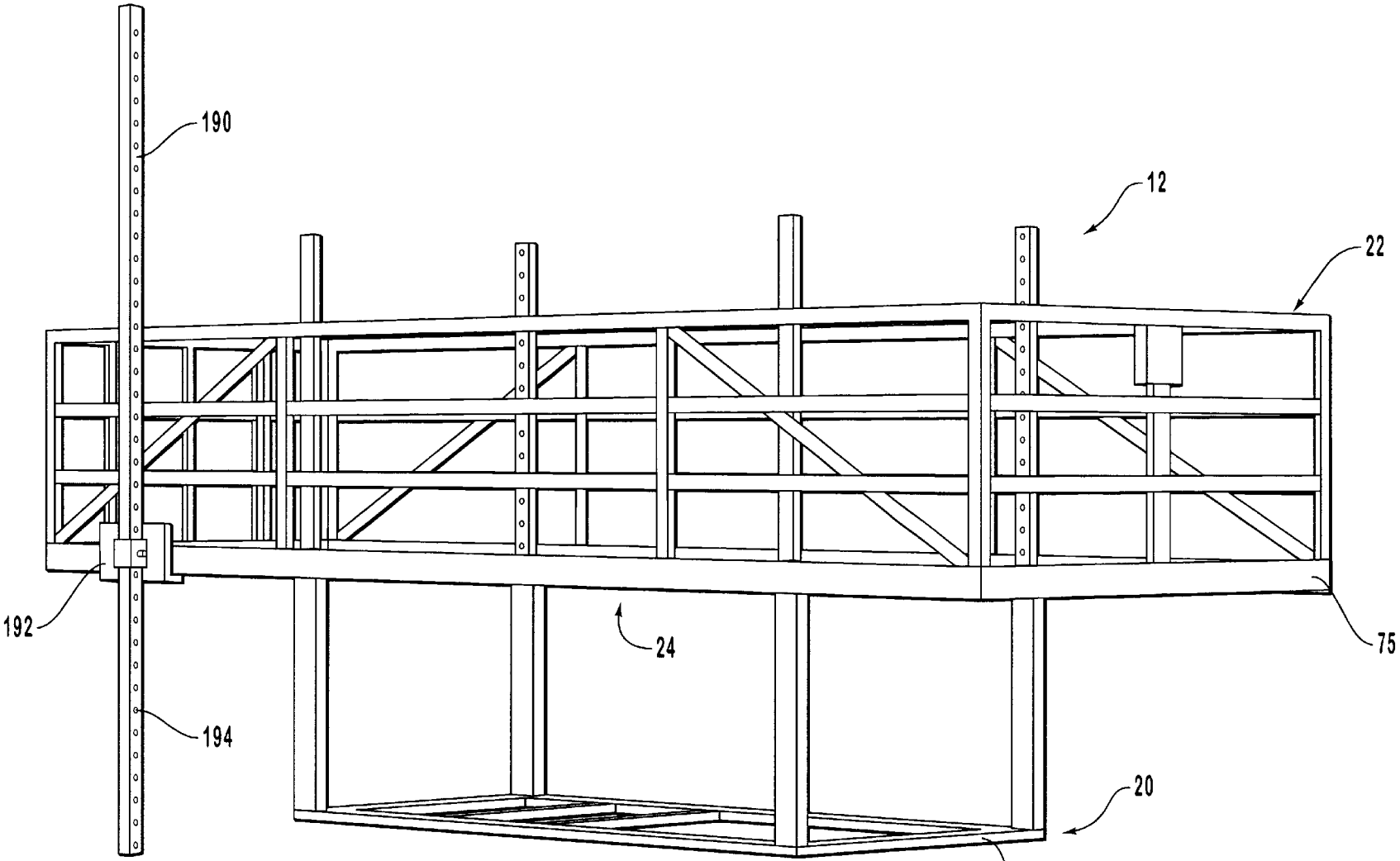
FIG. 10 is a perspective view of the lifting apparatus of FIG. 1 in a lowered position.
Figure 11:
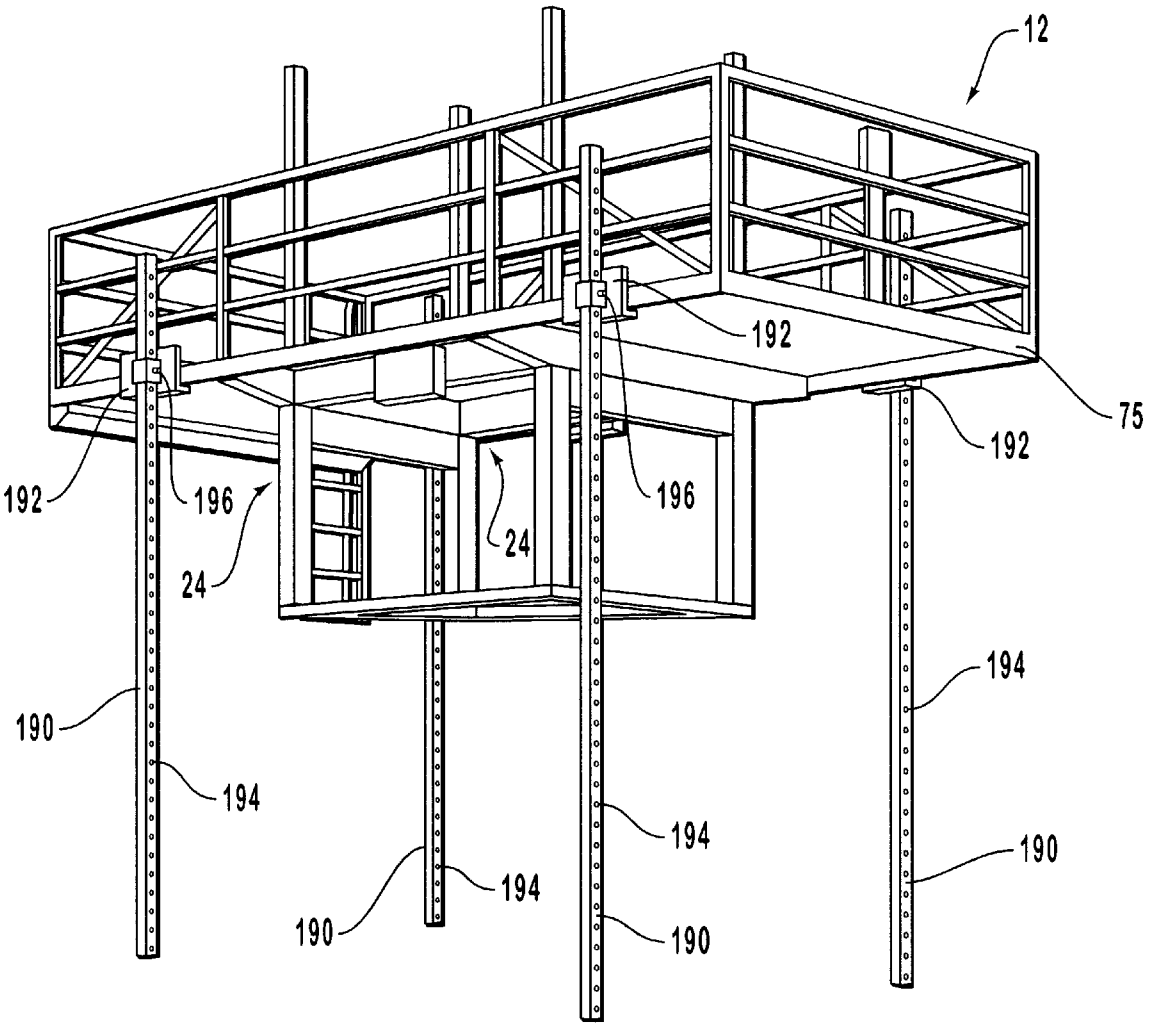
FIG. 11 is a perspective view of the lifting apparatus of FIG. 1 having a plurality of posts adapted to load/unload the lifting apparatus attached thereto.
Figure 12:
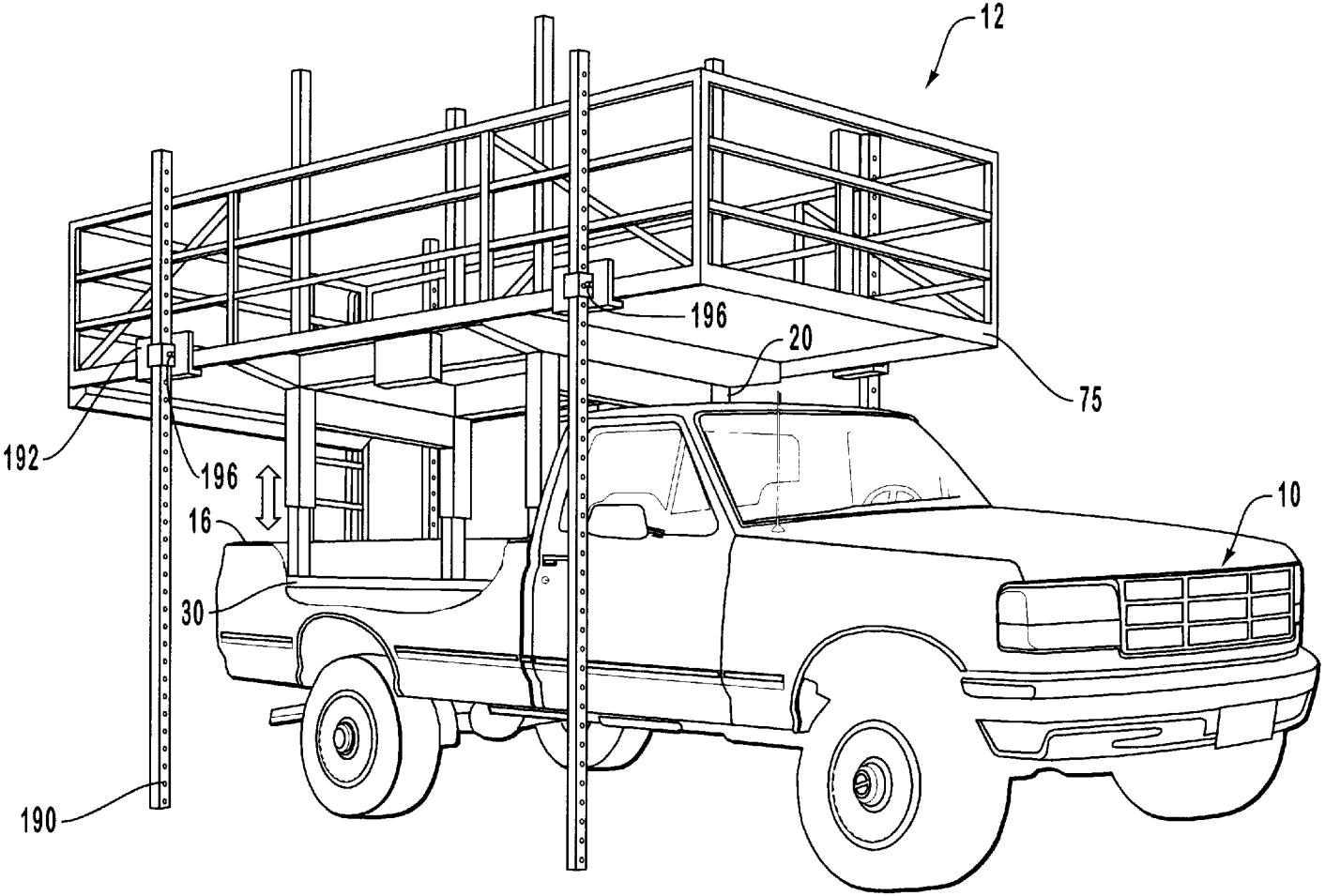
FIG. 12 is a partial cut-away perspective view of the lifting apparatus of FIG. 1 with the base assembly positioned for elevating and lowering the base assembly relative to the platform assembly and/or the vehicle.

Referring now to FIGS. 10–12, a method by which either lifting apparatus 12 or 212 is installed/removed or load/unload from vehicle bed 16 is depicted. Discussion will be made with respect to installation of lifting apparatus 12 to vehicle 10. It can be appreciated, however, that a similar discussion may be made with respect to lifting apparatus 212 and or to remove lifting apparatus 12, 212 from vehicle 10. Specifically, the method described herein may be performed in reverse order to remove lifting apparatus 12, 212.

As shown in FIG. 10, lifting apparatus 12 is in a lowered state with base 30 of base assembly 20 resting on the ground. In this lowered state four load/unload posts 190 are attached to platform 75 approximately near the corners thereof, only one being shown in FIG. 10. Each post 190 includes a sliding member 192 that attaches to platform 75 while capable of sliding along the longitudinal length of post 190. Additionally, each post 190 includes a plurality of holes 194 spaced longitudinally along the length thereof, that cooperate with sliding member 192 and securing pins 196, as described below. A lower end of each post 190 remains in contact with the ground, while the upper end of posts 190 extends beyond the upper most part of platform 75.

Upon attachment of the four posts 190 to platform 75, driving mechanism 24 is activated thereby raising platform 75 relative to base 30, as shown in FIG. 11. Once the desired height is reached a plurality of securing pins 196 are located within holes 194 to secure and retain platform 75 at the desired height. Upon insertion of securing pins 196 within the desired holes 194, driving mechanism 24 is activated as if to lower platform 75 toward base 30. However, since securing pins 196 are located within holes 194 platform 75 is unable to lower and instead base assembly 20 is raised toward platform 75, as indicated by the arrow in FIG. 12. Once base assembly 20 has reached platform 75, control pedestal 108, discussed above and shown in FIG. 4, automatically stops driving mechanism 24. As can be seen in FIG. 12, lifting apparatus 12 is, therefore, raised a distance from the ground sufficient to allow vehicle 10 to be positioned beneath. After base assembly 20 is raised, the appropriate vehicle, such as vehicle 10, is positioned beneath base 30 so that lowering of base assembly 20 locates base 30 within bed 16 of vehicle 10, as indicated by the arrow. Upon lowering of base 30 to bed 16 of vehicle 10, connecting mechanism 32 such as a coupler 50 (FIG. 2A), attaches base 30 to frame 18 and/or bed 16 of vehicle 10. Once lifting apparatus 12 is securely attached to vehicle 10, securing pins 196 are removed from securing holes 194 and platform 75 is lowered towards base assembly 20. Upon lowering platform 75, posts 190 are removed and vehicle 10 and lifting apparatus 12 are therefore ready for use as previously depicted in FIGS. 1 and 4.

In another embodiment of the method and apparatus described above, load/unload posts 190 are securely attached to platform 75. In this embodiment, each post 190 includes a rotating mechanism that allows rotation of each post 190 relative to platform 75. The rotating mechanism permanently attaches each securing post 190 to platform 75, while allowing each post 190 to rotate and rest along the sides of platform 75 when not in use for installation or removal of lifting apparatus 12 from vehicle 10. In this particular alternate embodiment, each post 190 is capable of being telescoped and retracted such that it may more easily conform to the longitudinal length of platform 75. Alternatively, each post 190 may be telescoped or extended during use of lifting apparatus 12 on vehicle 10, such that each post 190 give additional stability to lifting apparatus 12. Therefore, once platform assembly 22 is in the extended position, each post 190 contacts the ground or other surface upon which vehicle 10 rests, and securing pins 196 locate in holes 194.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A lifting apparatus for mounting upon a vehicle, the apparatus comprising:

(a) a base assembly having a plurality of columns extending therefrom and a connecting means for securely attaching the lifting apparatus to the vehicle, the connecting means also being configured to prevent movement of said base assembly relative to the vehicle;

(b) a platform assembly comprising a platform and a plurality of outer column receivers extending from the platform, each said outer column receiver adapted to cooperatively engage with a respective one of said columns of said base assembly; and (c) driving means for elevating and lowering said platform assembly relative to said base assembly and for further elevating and lowering said base assembly relative to said platform assembly and the vehicle.

2. The lifting apparatus as defined in claim 1, wherein said connecting means reversibly attaches the lifting apparatus to the vehicle.

3. The lifting apparatus as defined in claim 1, wherein said driving means comprises:

(a) a lifting chain having a first end attached to said base assembly and a second end attached to said base assembly;

(b) a gear assembly drivingly engaged with said lifting chain; and (c) a motor assembly coupled to said gear assembly and either said base assembly or said platform assembly such that activation of said motor assembly moves said platform assembly relative to said base assembly.

4. The lifting apparatus as defined in claim 3, wherein said driving means includes a plurality of lifting chains and a plurality of gear assemblies.

5. The lifting apparatus as defined in claim 1, wherein said driving means comprises a hydraulic ram extending between said base assembly and said platform.

6. The lifting apparatus as defined in claim 1, wherein said driving means comprises:

(a) a lifting chain having a first end attached to said platform assembly and a second end attached to said platform assembly;

(b) a gear assembly coupled to said base assembly and adapted to drivingly engaged with said lifting chain; and (c) a motor assembly coupled to said gear assembly and either said base assembly or said platform assembly such that activation of said motor assembly moves said platform assembly relative to said base assembly and the vehicle.

7. The lifting apparatus as defined in claim 1, further comprising safety means for controlling the descent of said platform assembly relative to said base assembly in the event of a malfunction of the lifting apparatus.

8. A lifting apparatus mountable to a vehicle, the apparatus comprising:

(a) a base assembly having at least one column extending therefrom and a connecting mechanism adapted to attach said base assembly to the vehicle and prevent movement of said base assembly relative to the vehicle;

(b) a platform assembly comprising a platform with at least one outer column receiver extending from said platform, said at least one outer column receiver cooperatively engaging with said at least one column of said base assembly; and (c) a driving mechanism adapted to elevate or lower said platform assembly relative to said base assembly and further adapted to elevate and lower said base assembly relative said platform assembly and the vehicle, said driving mechanism comprising:

(i) a lifting chain;

(ii) a gear assembly drivingly engaged with said lifting chain; and (iii) a motor assembly coupled to said gear assembly and either said base assembly or said platform assembly such that activation of said motor assembly rotates said gear assembly to move said platform assembly relative to said base assembly.

9. The lifting apparatus as defined in claim 8, wherein said lifting apparatus includes a plurality of lifting chains and a plurality of gear assemblies to elevate said platform upon activation of said motor assembly.

10. The lifting apparatus as defined in claim 8, wherein said connecting mechanism comprises a coupler attached to said base assembly and a hitch ball attached to the vehicle, said coupler being configured to mate with said hitch ball.

11. The lifting apparatus as defined in claim 8, further comprising safety means for controlling the descent of said platform assembly relative to said base assembly in the event of a malfunction of the lifting apparatus, the safety means being coupled to at least one of said platform assembly, said base assembly, and said driving mechanism.

12. The lifting apparatus as defined in claim 11, wherein said safety means comprises a hydraulic ram extending substantially between said platform assembly said base assembly.

13. The lifting apparatus as defined in claim 11, wherein said safety means comprises a plurality of pins that releasably engage and disengage with complementary holes formed in said columns as said platform assembly slidably engages with said columns.

14. The lifting apparatus as defined in claim 11, wherein said safety means comprises a pneumatic brake assembly coupled to said platform assembly and said base assembly.

15. The lifting apparatus as defined in claim 8, further comprising a control pedestal that allows a user to operate the lifting apparatus.

16. The lifting apparatus as defined in claim 8, wherein said gear assembly is contained within a housing adapted to protect said gear assembly.

17. The lifting apparatus as defined in claim 8, wherein said lifting chain has a first end attached to said platform assembly and a second end attached to said platform assembly.

18. The lifting apparatus as defined in claim 8, wherein said lifting chain has a first end attached to said base assembly and a second end attached to said base assembly.

19. A lifting apparatus for mounting to a vehicle, the apparatus comprising:

(a) a base assembly having a plurality of substantially vertical columns extending from said base assembly;

(b) a connecting mechanism adapted to securely attach said base assembly to the vehicle and prevent movement of said base assembly relative to the vehicle;

(c) a platform assembly comprising a platform and a plurality of outer column receivers extending from said platform, each said outer column receiver cooperatively engaging with a respective one of said columns of said base assembly;

(d) a driving mechanism adapted to elevate or lower said platform relative to said base assembly and further adapted to for elevate or lower said base assembly relative to said platform assembly and the vehicle, the driving mechanism comprising:

(i) a lifting chain;

(ii) a gear assembly drivingly engaged with said lifting chain; and (iii) a motor assembly coupled to said gear assembly and either said base assembly or platform assembly such that activation of said motor assembly rotates said gear assembly to move said platform relative assembly to said base assembly.

(e) a safety mechanism coupled to said base assembly and said platform assembly and adapted to control the descent of said platform assembly relative to said base assembly in the event of a malfunction of the lifting apparatus.

20. The lifting apparatus as defined in claim 19, wherein said safety mechanism comprises a hydraulic ram.

21. The lifting apparatus as defined in claim 20, wherein said platform assembly is formed of a material substantially comprising aluminum.

22. The lifting apparatus as defined in claim 20, wherein said motor assembly includes a motor and a linking chain.

23. The lifting apparatus as defined in claim 20, wherein said driving mechanism is capable of being operated from atop, remotely, or below said platform.

24. The lifting apparatus as defined in claim 23, wherein said platform assembly further comprises a retractable ladder.

25. A method for installing a lifting apparatus onto a vehicle, comprising the steps of:

(a) providing a lifting apparatus comprising:

(i) a base assembly comprising a base with a plurality of columns extending therefrom and a connecting mechanism configured to attach the base assembly to the vehicle and prevent movement of the base assembly relative to the vehicle;

(ii) a platform assembly comprising a platform and a plurality of outer column receivers extending from said platform, each said outer column receiver slidably engaging with respective one of said columns of said base assembly; and (iii) a driving mechanism adapted to move said platform assembly relative to said base assembly;

(b) coupling a plurality of posts to the platform assembly, each of the plurality of posts including a member slidably coupled to the post and a plurality of holes disposed therein, each of the plurality of holes being configured to receive a securing pin;

(c) upon activating said driving mechanism to move said platform assembly relative to said base assembly, locking said platform assembly in a first position by locating at least one securing pin in at least one of the plurality of holes in each of the plurality of posts;

(d) positioning said base assembly below said platform assembly by activating said driving mechanism to raise said base assembly toward said platform assembly when said platform assembly is in the first position; and (e) in the event that the lifting apparatus is to be installed onto the vehicle, upon positioning the vehicle below the base assembly, lowering said base assembly relative to the vehicle such that the connecting mechanism attaches the lifting apparatus to the vehicle.

26. The method as recited in claim 25, wherein the step of lowering said base assembly comprises activating said driving mechanism such that said base assembly is lowered toward the vehicle.

27. The method as recited in claim 25, wherein the step of lowering said base assembly comprises activating said driving mechanism such that said base assembly is lowered toward the ground.

28. The method as recited in claim 25, further comprising removing the plurality of posts from the platform assembly.

29. The method as recited in claim 25, further comprising, removing the lifting apparatus from the vehicle.

30. The method as recited in claim 29, further comprising:

(a) attaching the plurality of posts to the platform assembly and locking said platform assembly in a first position by locating said at least one securing pin in at least one of said plurality of holes in each of said plurality of posts; and (b) releasing said connecting mechanism to release the lifting apparatus from the vehicle; and (c) activating said driving mechanism to move said base assembly relative to said platform assembly to thereby remove the lifting apparatus from the vehicle.

31. A method for removing a lifting apparatus from a vehicle, the lifting apparatus including a base assembly having a connecting mechanism for connecting the base assembly to the vehicle, a platform assembly coupled to the base assembly, and a driving mechanism for moving the base assembly relative to the platform assembly or the platform assembly relative to the base assembly, the method comprising the steps of:

(a) locking the platform assembly in a first position by attaching a plurality of posts to a platform assembly and locating at least one securing pin in at least one of a plurality of holes formed in each of said plurality of posts;

(b) releasing the connecting mechanism to release the lifting apparatus from the vehicle; and (c) activating the driving mechanism to move the base assembly relative to the platform assembly and the vehicle to thereby remove the lifting apparatus from the vehicle.

32. A lifting apparatus for mounting upon a vehicle, the apparatus comprising:

(a) a base assembly having a plurality of columns extending therefrom and a connecting means for securely attaching the lifting apparatus to the vehicle;

(b) a platform assembly comprising a platform and a plurality of outer column receivers extending from the platform, said outer column receivers adapted to cooperatively engage with respective one of said columns of said base assembly; and (c) driving means for elevating and lowering said platform assembly relative to said base assembly and for further elevating and lowering said base assembly relative to said platform assembly and the vehicle.

* * * * *

UNITED STATES PATENT AND TRADEMARK OFFICE

CERTIFICATE OF CORRECTION

PATENT NO. : 6,349,793 B1
DATED : February 26, 2002
INVENTOR(S) : Duanne Kincaid It is certified that error appears in the above-identified patent and that said Letters Patent is hereby corrected as shown below:

Title page,
Inventor, change "Duane" to -- Duanne --

Column 3,
Line 60, after "to show" and before "manner" insert -- the --

Column 5,
Line 25, after "ends" change "thereof" to -- thereof. --

Column 18,
Line 37, after "adapted to" and before "elevate" delete "for"

Signed and Sealed this

Third Day of September, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,349,793 B1
DATED : February 26, 2002
INVENTOR(S) : Duane Kincaid

It is certified that error appears in the above-identified patent and that said Letters Patent is hereby corrected as shown below:

Title page,
Item [76], Inventor, change "Duanne" (as in Certificate of Correction issued September 3, 2002) to -- Duane --

Signed and Sealed this

Twenty-seventh Day of May, 2003

JAMES E. ROGAN
*Director of the United States Patent and Trademark Office*